US009764382B2

(12) United States Patent
Martin et al.

(10) Patent No.: US 9,764,382 B2
(45) Date of Patent: Sep. 19, 2017

(54) LINED CENTRIFUGAL MOULD WITH CONTROLLED THERMAL INERTIA

(71) Applicant: Safran Aircraft Engines, Paris (FR)

(72) Inventors: Guillaume Martin, Moissy-Cramayel (FR); Serge Fargeas, Moissy-Cramayel (FR); Marc Soisson, Moissy-Cramayel (FR); Valéry Piaton, Moissy-Cramayel (FR)

(73) Assignee: Safran Aircraft Engines, Paris (FR)

( * ) Notice: Subject to any disclaimer, the term of this patent is extended or adjusted under 35 U.S.C. 154(b) by 0 days.

(21) Appl. No.: 15/115,218

(22) PCT Filed: Jan. 28, 2015

(86) PCT No.: PCT/FR2015/050193
§ 371 (c)(1),
(2) Date: Jul. 28, 2016

(87) PCT Pub. No.: WO2015/114250
PCT Pub. Date: Aug. 6, 2015

(65) Prior Publication Data

US 2016/0339512 A1 Nov. 24, 2016

(30) Foreign Application Priority Data

Jan. 31, 2014 (FR) ..... 14 50800

(51) Int. Cl.
*B22D 13/10* (2006.01)
*B22D 27/20* (2006.01)

(52) U.S. Cl.
CPC ..... *B22D 13/102* (2013.01); *B22D 13/101* (2013.01); *B22D 27/20* (2013.01)

(58) Field of Classification Search
CPC ..... B22D 13/101; B22D 13/102
USPC ..... 164/286, 289, 290, 296
See application file for complete search history.

(56) References Cited

U.S. PATENT DOCUMENTS

| | | | | |
|---|---|---|---|---|
| 2,378,042 | A * | 6/1945 | Sorensen | B22D 13/066 164/290 |
| 4,031,947 | A * | 6/1977 | Connolly | B22D 13/066 164/114 |
| 6,443,212 | B1 | 9/2002 | Choudhury et al. | |
| 6,776,214 | B2 * | 8/2004 | Ray | B22D 13/00 164/267 |
| 2005/0011627 | A1 * | 1/2005 | Noble | B22D 13/02 164/114 |
| 2016/0339511 | A1 * | 11/2016 | Digard Brou De Cuissart | B22D 13/102 |

FOREIGN PATENT DOCUMENTS

EP 0 992 305 A1 4/2000

* cited by examiner

*Primary Examiner* — Kevin E Yoon
(74) *Attorney, Agent, or Firm* — Blank Rome LLP

(57) ABSTRACT

The invention concerns a unit comprising a mold (4) adapted to receive a molten metal alloy and the said metal alloy poured therein. The alloy is TiAl. The mold is rotational and comprises receiving recesses (135) made of steel, metal alloy and/or ceramic, and, at the location of a plurality of section planes each passing through the mold and the poured metal alloy, the mold has a surface heat capacity less than that of the poured metal alloy.

4 Claims, 6 Drawing Sheets

Figure 1:
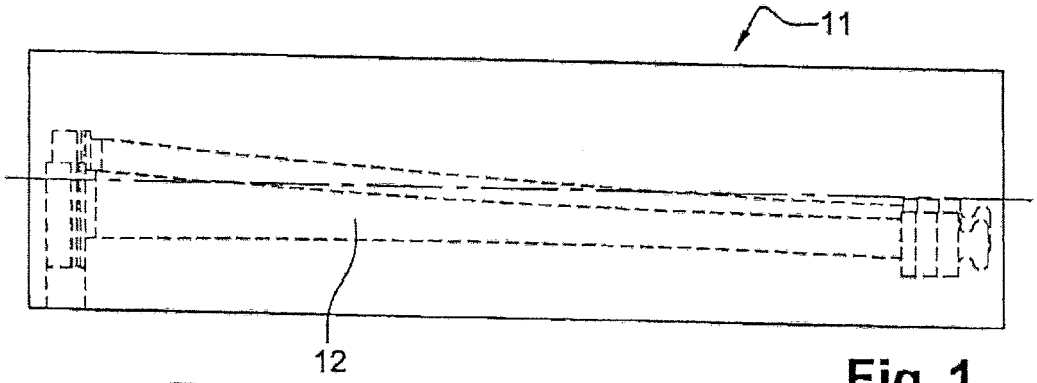
Fig. 1 PRIOR ART

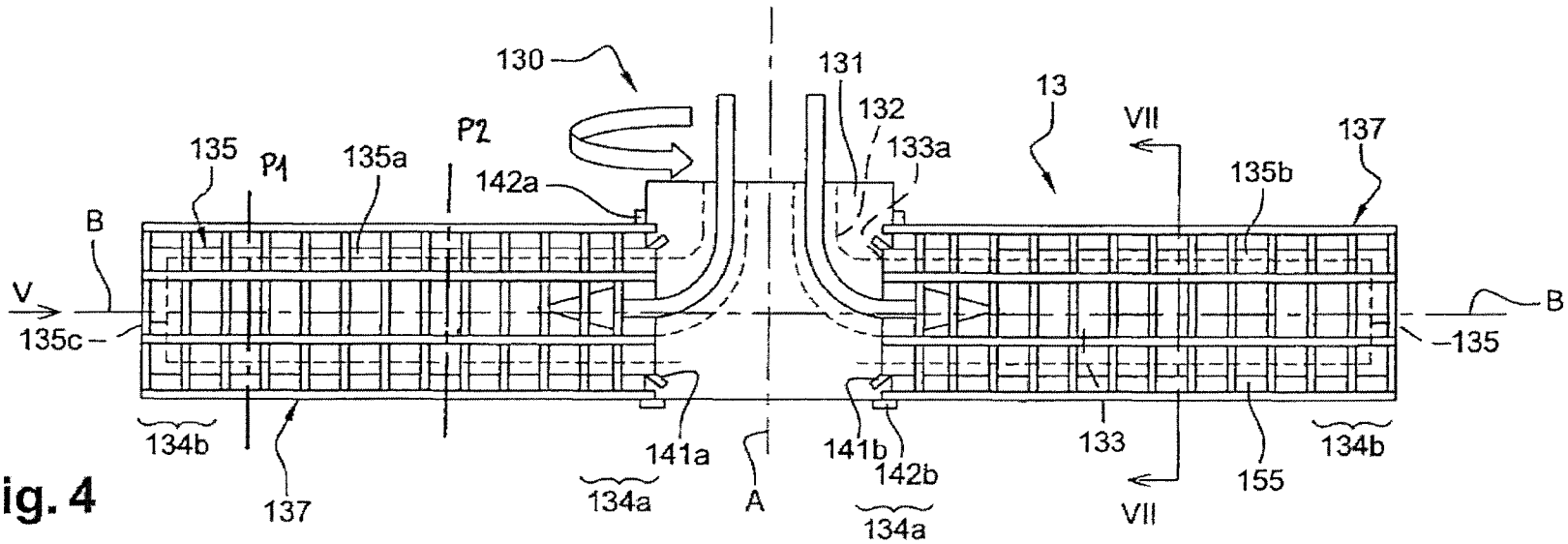
Fig. 4
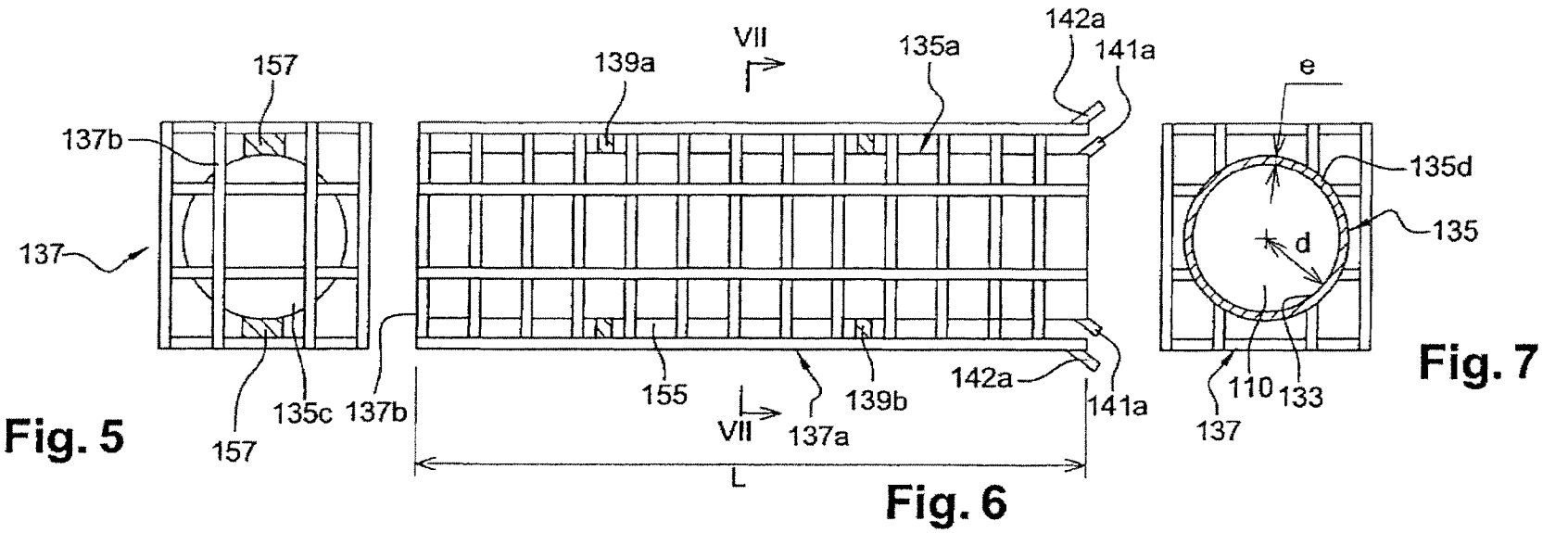
Fig. 7
Fig. 6
Fig. 5

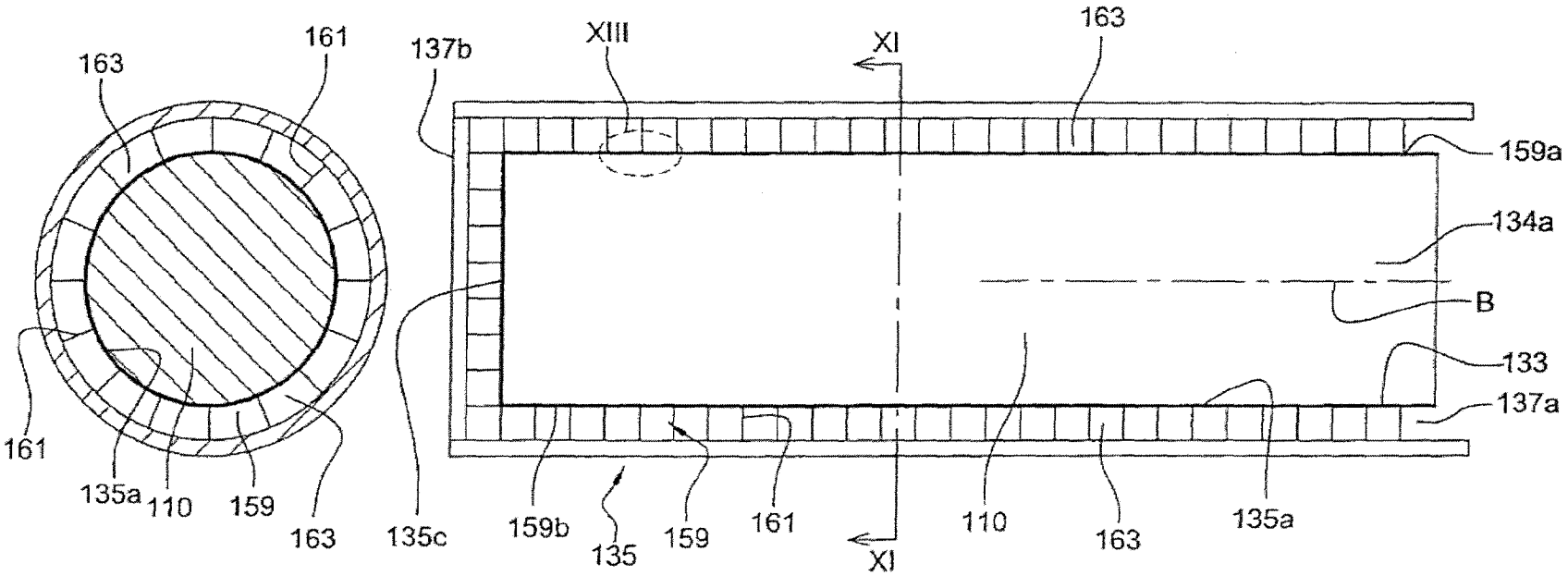
Fig. 11
Fig. 12
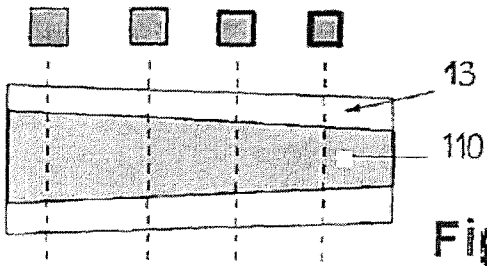
Fig. 23
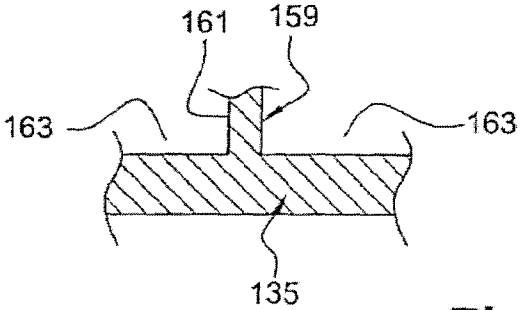
Fig. 13

LINED CENTRIFUGAL MOULD WITH CONTROLLED THERMAL INERTIA

The invention relates to the moulding of metal parts by centrifuge casting, especially turbine engine blades, and more specifically turbine blades for aircraft turbojets or turboprops. Are specifically concerned, a mould, its use, and the unit comprising the mould and the molten metal alloy that is poured therein.

Until now turbine engine blades have been produced by machining a rough cast obtained by means of casting. Typically, the rough cast is a bar, i.e. a block of material that is generally of an extended shape.

One of the techniques used to obtain the rough cast is lost-wax casting wherein the metal alloy is poured into a pre-heated ceramic mould, which is either centrifugal or not. In this case, the shape of the rough cast may approach the final machined geometry. This mould can only be used once. Furthermore, the chemical interactions between the molten alloy and the ceramic may generate surface defects on the rough cast, Another solution consists in casting the bars in a permanent centrifugal mould. This appears to be promising, especially to manufacture TiAl based metal alloy blades, more specifically with $\beta/\alpha$ solidification.

However, these bars are segregated, especially in aluminium, and the chemical heterogeneity can lead locally to properties that do not conform to the expected requirements.

It is therefore important to control (limit/eliminate) these segregations.

One problem to solve concerns the control of the speed at which the molten alloy cools after casting, to encourage the achievement of a consistent aluminium rate in the bar, and therefore a controlled micro structure. It is to be noted that the problem can therefore occur with metal alloys containing aluminium other than the above mentioned TiAl.

The bars cast using the centrifugal casting method are currently mainly destined for remelting. The segregations are then no longer a problem because they will be re-homogenised when they are remelted. If it is intended to use these cast bars directly, the simplest solution would be to heat the moulds to restrict the heat gradients and thereby limit the segregations. However, centrifuge casting installations are not, or little adapted to the pre-heating of metal moulds. This solution is not, therefore, perfect.

Thus, the technical solutions described below are the result of an effort to understand and explain the phenomena in play during the solidification of alloy bars, especially made from TiAl.

According to a first definition, the solution proposed herein consists in recommending the use of a unit (or assembly) comprising:

a mould adapted for the pouring therein of a molten metal alloy, and the said metal alloy poured into the mould, characterised by:

the metal alloy TiAl, the mould is rotational for centrifugal casting and comprising receiving recesses made of steel, metal alloy and/or ceramic adapted so that the said TiAl molten alloy can be poured therein centrifugally, and at the location of a plurality of section planes each passing through the mould and the poured metal alloy, the mould has a surface heat capacity (C1, Ci) less than that (C1',Ci') of the poured metal alloy, To favour control over the cooling, it is further proposed that the mould comprise:

several receiving recesses extending radially around the mould's rotational axis, and at least one hollow exoskeleton in which liners are housed together defining the said recesses, having as additional specificities:

that the exoskeleton or exoskeletons are open-work, or that an empty space exists around the periphery between each lining and the exoskeleton that surrounds it, or that an alveolar structure extends peripherally between each lining and the exoskeleton.

By using such a recessed mould, it will especially be possible to:

propose thin liner walls with low heat inertia, and/or propose variable thickness liner walls with controlled heat inertia, to tend towards the effective controlled cooling of the cast alloy, to have the mechanical strength of the whole essentially guaranteed via the external exoskeleton structure.

It is further recommended that, relative to the molten metal alloy, the liners have a preponderant thermal behaviour compared to that of the exoskeleton(s).

Concerning the mould itself, besides its rotational nature adapted to centrifugal casting, therefore with liners defining all the recesses together and which are housed in at least one hollow exoskeleton, it is planned that the exoskeleton or exoskeletons are made from soft steel, steels or metal alloys and that the liners are made from soft steel, steels or metal alloys and/or ceramic.

Thus, (and this is therefore valid in the location of each amongst a plurality of section planes along any liner), we recommend:

that together, a liner and the exoskeleton (or part of exoskeleton) that surrounds it have a first surface heat capacity, that the molten alloy poured into this liner has a second surface heat capacity, and that the couple formed by each liner and its exoskeleton on the one hand, and the alloy on the other, are selected so that the ratio between the first and second surface heat capacities is less than 1.

Thus, this invention will make it possible to remedy at least part of the above mentioned disadvantages, simply, effectively and economically.

In the case of a TiAl block, achieving the above mentioned ratio makes it possible to obtain aluminium segregations between the core and the periphery in the order of 0.2% weight.

It is also to be noted that by using a solution with liners and exoskeletons, it will be possible to dissociate:

certain physical characteristics of the exoskeleton or exoskeletons, which may contribute to the more or less quick dissipation of the heat from the casting, while taking on a major part of the forces during centrifuging (we recommend a strength making it possible to withstand a centrifuge acceleration of more than 10 g), compared to the physical characteristics of the liners which can therefore be thin and/or in a material different from that of the exoskeleton(s).

It will therefore be possible to work the liner shapes more appropriately (especially interior), without necessarily working those of the exoskeleton(s) in the same way.

It should further be noted that an alveolar structure extending peripherally between each liner and the exoskeleton surrounding it would typically make it possible, because of its boxed structure, to favour the thermal control and or mechanical strength, as would the manufacture of the exoskeleton(s) in open-work (also called open box): the thermal inertia would then be lower than if the same exoskeleton(s) had solid walls.

Same consideration if, as recommended:

the exoskeleton or exoskeletons are made from steel and the liners made from a metal material of a lower thermal inertia, or are made from a heat resistant material or materials, and/or individually the liners have a peripheral wall; between two opposing free ends, a length according to the radial direction along which each one extends and along this length, a central duct through which the alloy is poured with an average cross section and, an average peripheral wall thickness less than ⅛, and preferably ⅒, of one of the dimensions of the said cross section Furthermore, it is planned, independently or in combination:

that the exoskeleton or exoskeletons may be open-work (open box), that an empty space may exist around the periphery between each lining and the exoskeleton that surrounds it, that an alveolar structure extends peripherally between each lining and the exoskeleton that surrounds it.

This will be favourable to controlling the heat gradients, controlling solidification and therefore controlling segregation.

Using metal liners, the limitation of contamination of the rough cast material by the mould material will be favoured.

Furthermore, the above will be further approached by using a rotational mould as above, with recesses made from steel, metal alloy and/or ceramic, receiving a TiAl metal alloy, and respecting the ratio of surface heat capacity mentioned previously.

Figure 2:
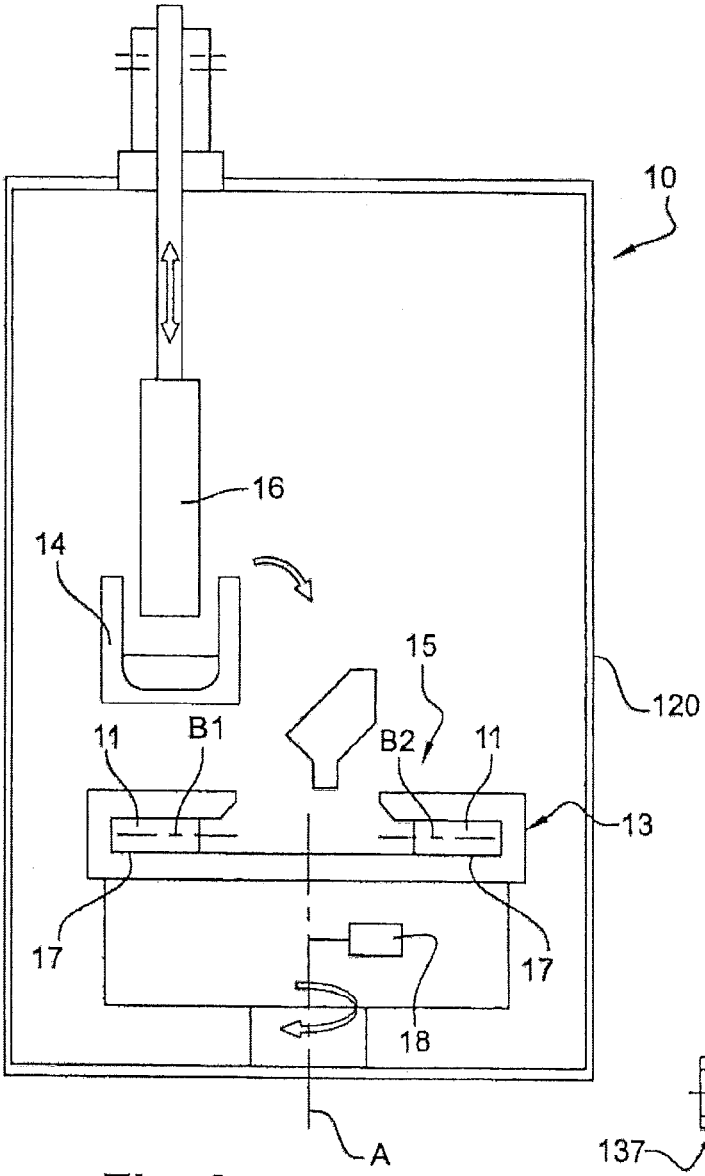
Fig. 2 PRIOR ART
Figure 3:
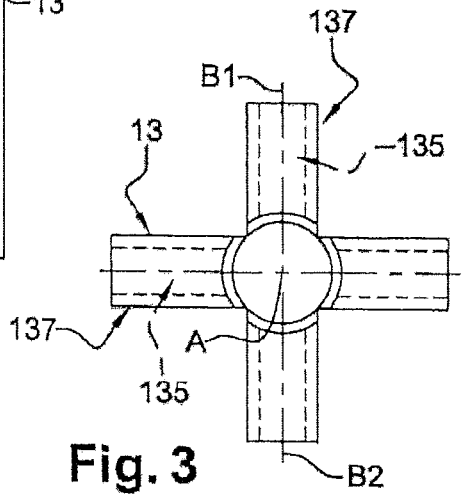

The other advantages and characteristics of the invention will become apparent from reading the description made as a strictly non-limiting example in relation to the appended figures, in which:

FIG. 1 is a schematic front view of a solid bar produced by the pre-dating technique, in which at least one turbine engine turbine blade is to be machined, FIG. 2 is a schematic view of a mould used for the pre-dating technique, FIG. 3 is a schematic view of the top of a mould with liners and exoskeletons, in which bars with less segregation will be cast, FIGS. 4,5,6,7,8,9,10,11,12,13,14,15,16,17,18,19,20,21 are schematics of different embodiments of liners and exoskeletons according to different methods of manufacture, showing front views (FIGS. 4,6), schematic longitudinal cross sections (one of the radial axes B; FIGS. 12,14,17,18, 20) or transverse cross sections (FIG. 7, cross section VII-VII, FIG. 11, cross section XI-XI, FIGS. 15,16,19,21), side views (FIG. 5—view as per V- and FIGS. 8,9,10,); FIG. 13 is a detail of an alternative production of zones identical to that referenced XIII, FIG. 22 is a graph showing the test results obtained over several TiAl casts using steel moulds of different shapes and thickness, with the (Ci/Ci') ratio on the X axis and the segregation shown in the cast alloy on the Y axis (in weight of Al), and FIG. 23 is a schematic of the locations of the four square sections (54, 56, 58 and 61 mm shown in FIG. 22) selected to characterise a single variable cross section mould.

FIG. 1 features a cast metal bar 11 from which at least one, here two, turbine engine turbine blades 12 are to be milled.

The bar 11 can be cylindrical and is solid. It is obtained by casting a metal alloy in a mould.

FIG. 2 shows a conventional system 10 for the production or the bars or rough casts 11 using successive melting and casting operations.

The system 10 includes a closed enclosure 20 in which a partial vacuum is created. A bar 16 of metal alloy, here TiAl based, is first melted in a crucible 14. When molten, it is poured into a permanent metal mould 13.

The mould 13 is used to cast the alloy centrifugally in order to obtain bars 11. To achieve this, it is put into rotation around a vertical axis A, preferably using a motor 18. The mould 13 includes several recesses or cavities 17, that extend radially (axes B1, B2; FIGS. 2,3) around axis A. These cavities are preferably regularly spaced at angles around axis A which here is vertical. The alloy to be cast, fed into the centre of the mould, spreads into the cavities.

After cooling, the mould 13 is removed and the cast bars 11 are removed. The mould thicknesses can lead to high thermal inertia and create significant heat gradients during the cooling of the cast metal, generating radial segregations, especially aluminium, from the centre to the periphery of the bars. During the solidification of the alloy, the aluminium segregation generates the progressive weakening of the residual liquid during the growth of the dendrites from the wall of the mould. The parts made from bars 11 can therefore have differences in micro-structure.

Furthermore, in the event of wear, the part of the mould surrounding the radial recess 17 in question must be replaced.

The invention makes it possible to provide a solution to the above mentioned segregation problem and, if necessary, to meet the strength requirements for the centrifuge force and the fast and frequent replacement of at least part of the mould.

To this end, it is planned that the selected mould 13 be designed, then the centrifuge casting of the blocks 11 performed, so that at the location of a plurality of section planes (such as P1, P2 FIG. 4, P3, P4 FIG. 14, P5, P6 FIG. 18) passing through the mould and the molten metal alloy therein 11 (at its contact; see FIG. 14), this mould has a surface heat capacity (Ci) less than that (Ci') of the molten metal alloy therein. Even though this is not limiting in any way, the illustrated section planes are perpendicular to axis B.

Thus, for example at the location of section plane P1 in FIG. 4:

$C1=\rho1 \cdot S1 \cdot c1$ ($kJ \cdot K^{-1} \cdot m^{-1}$), the surface heat capacity of the mould (here therefore of the liner 135 surrounded by exoskeleton 137), and $C1'=\rho1' \cdot S1' \cdot c1'$ ($kJ \cdot K^{-1} \cdot m^{-1}$), the surface heat capacity of the molten metal alloy 11, where:

ρ1 and ρ1' are the respective densities of the material composing the mould, and of this metal alloy, S1 and S1' are the respective cross sections of the mould (liner 135 surrounded by exoskeleton 137), and of this metal alloy, and c1 and c1' are the specific heat of the mould (liner 135 surrounded by exoskeleton 137), and the metal alloy, it is planned:

that $C1/C1'<1$ and that this is also verified or demonstrated at the location of other section planes, such as those referenced P2, P3, P4, P5, P6.

The limit value (mould surface heat capacity/surface heat capacity of the metal alloy poured in contact with it <1) has been established using results obtained especially by several TiAl casts into steel moulds of different shapes and thicknesses. For each bar, the segregation was obtained by carrying out precise aluminium content measurements (uncertainty less than 0.06% in weight Al-wt Al) at the surface and the core of the bar. The measured difference defines the radial macro-segregation. The results are shown in FIG. 22 in which the shapes of the tested liners and the radial vertical cross section conformation compared to the example of axes B1 or B2 FIG. 2 (solid peripheral wall, relative dimensions, etc.) have been shown, with precise dimensional values. The square sections (54, 56, 58 and 61 mm) are from a single, variable cross section mould (FIG. 23); the radial segregation was measured for these four sections and compared with the specific ratio for each section.

The three sections with a ratio less than 1 (to the nearest 10%) have periphery-core radial segregations less than or equal to 0.2% wt (to the nearest 10%). On the other hand, all the sections with a ratio higher than 1 show a higher aluminium segregation, increasing proportionally to the ratio.

FIGS. 3 to 21 represent the methods of producing a mould 130 according to the invention, it being noted that FIG. 5 and following are schematics of the alternatives. As for all the functional resources with which these manufactured moulds are preferably fitted, they have neither been illustrated nor systematically repeated in all the alternatives described hereafter. The specificities of the production methods can be combined and apply from one method to the next.

Mould 130 differs from mould 13 in the manufacture of certain of its structural resources.

Around the central block 131, through the internal ducts 132, from which the alloy is radially spread around vertical axis A, liners 135 are regularly spaced (or for example 135*a*, 135*b* FIG. 4). The ducts 132 respectively come out in radial ducts 133 which receive the alloy through an opening 133*a* and each extend inside one of the liners, in a radial direction B. The opening 133*a* of each line is thus located in the extreme radial inner part 134*a* of the duct in question.

The liners, which are therefore hollow, are placed in at least one exoskeleton 137, and preferably in as many exoskeletons as there are liners, each exoskeleton then containing a liner 135 defining the said recesses.

The exoskeleton or exoskeletons hold the liners relative to the centrifugal forces generated by the rotation of the mould.

FIG. 4, the central rotation axis A of the mould is vertical and both the liners 135 and the exoskeletons 137 each extend along a horizontal longitudinal axis (axis B).

At its radially exterior end (extremity part 134*b*), each duct 133 has a solid bottom 135*c*.

Similarly, each exoskeleton 137 has, at its radially internal end, an opening 137*a* (see for example FIGS. 12, 17) through which, for example, a liner 135 can pass and, at its radially exterior end, a bottom 137*b* that can participate in the radial holding of the liner.

FIG. 6, it can be noted in 139*a*, 139*b* that there are fixings, here removable, between the illustrated liner, here 135*a*, and the exoskeleton, here 137*a*, that surrounds it, to allow the liner to be replaced. Screw fixing may be suitable.

It can also be seen, see FIG. 4, that the removable fixings, such as 141*a*, 141*b*, are provided between each liner (and/or the surrounding exoskeleton, references 142*a*, 142*b*) and the central block 131.

It will thus be possible to separate the liners from the exoskeletons and the central block 131, especially to replace these liners. Once again, screw fixing may be suitable.

The removable fixings between the liners and exoskeletons(s) and/or between the central block 131 and the liners and/or exoskeleton(s) may form thermal break zones.

In a preferred manufacture mode, the exoskeleton or exoskeletons are made from steel (such as soft steel) and the liners made from a metal material of a lower thermal inertia, or made from a heat resistant material or materials.

FIG. 7, the peripheral wall is referenced 135*d* and, at its centre, can be seen the cast bar (rough cast) 110 from the casting.

Figure 8:
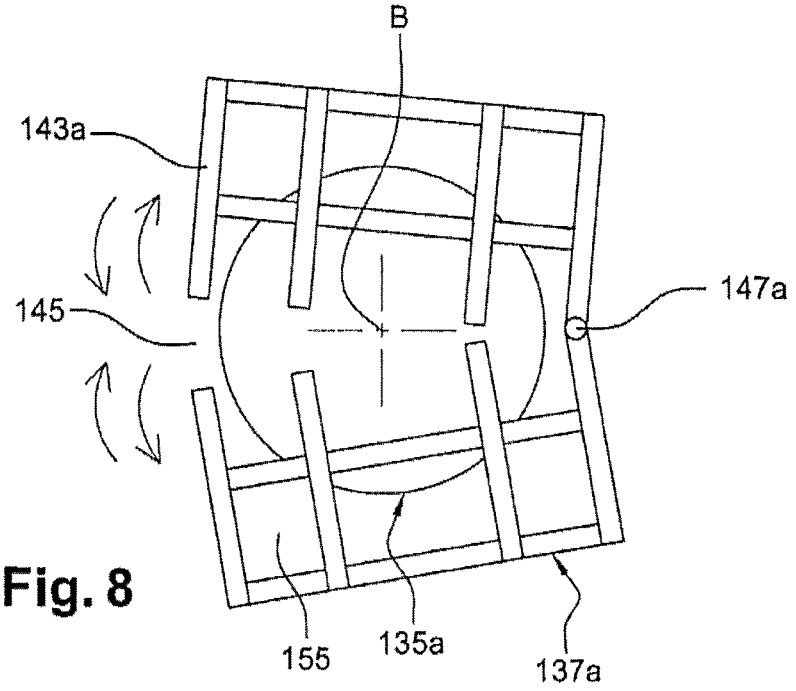

FIG. 8 shows a solution in which the schematic exoskeleton 137*a* is fitted with a moving door 143*a* which, when open, releases an opening 145 used to pass the liner in question, here 135*a*, through it. Hinges 147*a* may facilitate the operation of each moving door.

On FIGS. 4 to 8 it should also be noted that the exoskeletons are in open-work.

They are in the form of sorts of meshed cages.

To favour a low thermal inertia, here it is planned for there to be a space 155 peripherally (around axis B) between each liner, such as 135*a* and the exoskeleton, such as 137*a*, surrounding it.

Locating or centring devices 157 position the liner in question compared to the exoskeleton in a fixed manner, at least during the centrifuge phase, for the casting (see FIG. 5).

Figure 9:
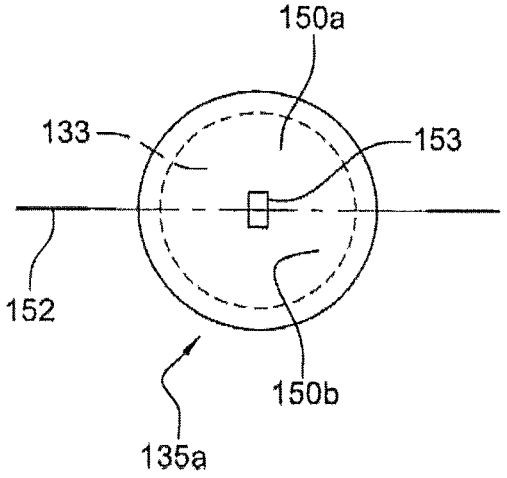
Figure 10:
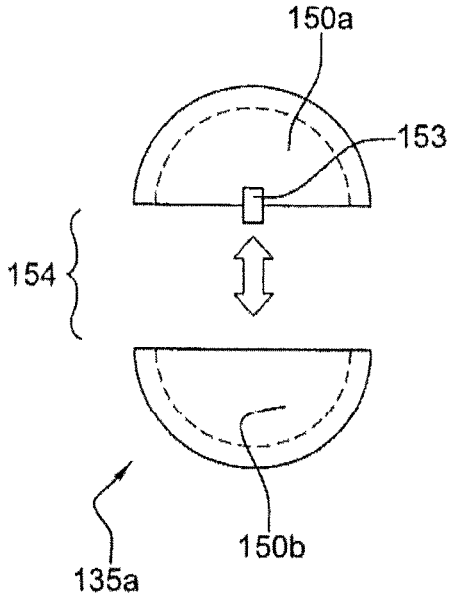
Figure 14:
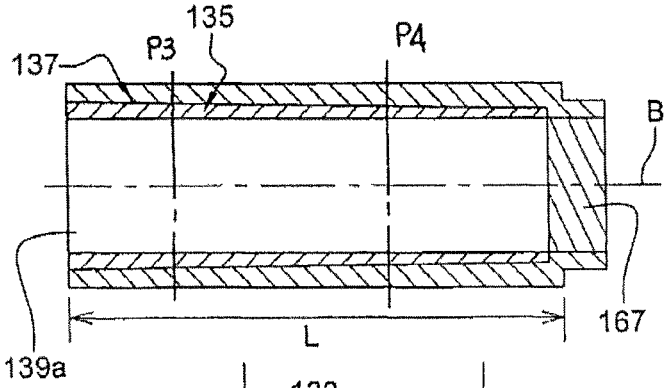
Figure 15:
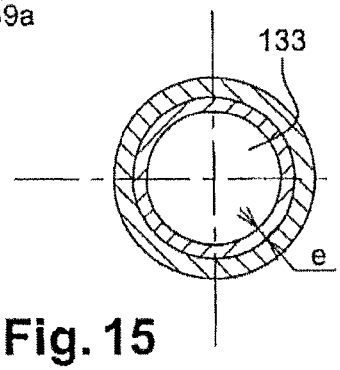
Figure 16:
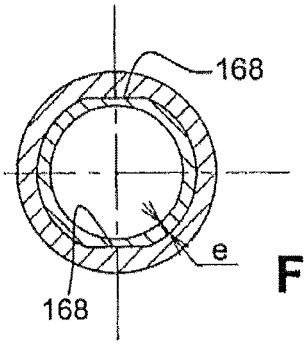

FIGS. 9,10 the liners are formed individually of several shells, such as 150*a*, 150*b*.

These shells open and close on a surface (here the gasket plane 152) which is globally transversal to the axis (A) around which the mould rotates.

Furthermore, a separable fixing 153, such as a bolt, is located between the shells, once they have been separated, to be able to extract the bar 110 from inside the liner in question, here 135*a*, by the released opening 154.

In the solution in FIGS. 11, 12, an alveolar structure 159, that extends peripherally between each liner, such as 135*a*, and the exoskeleton that surrounds it, such as 137*a*, plays this role and therefore defines at least a part of the said above mentioned locating resources 157.

The alveolar structure 159 can be annular. It can occupy a space between the bottom 135*c* of the liners and that 137*b* of the exoskeleton in question (FIG. 12).

Comprising for the sought thermal exchanges, FIG. 13 shows that the liner in question and the alveolar structure, such as 159, are in contact at discrete locations, such as 159*a*, 159*b*.

Rather than in separate parts, it could be planned to manufacture the liner and the alveolar structure in a single part (FIG. 13), so that they join at these discrete zones located at the radially interior end of the walls 161 separating the alveoli cavities 163 two by two.

Alternatively, it will be possible to manufacture each liner, such as 135*a*, of the said structure 159 that surrounds it and the exoskeleton, such as 137*a*, that surrounds this structure, into three separate elements, that can be separated from each other, the liner and the structure being engaged in the exoskeleton, concentrically, therefore following a radial B to the axis A.

FIGS. 14 to 21, but this can apply to the previous cases, the exoskeleton(s), such as 137*a*, individually include a radially exterior end 137*c* (FIGS. 17, 18) towards which the composed liner 135*a* is radially resting against a transversal surface 165 of the exoskeleton.

The radially external end 137*c* may be open.

An added cap 167 (which can be removable) will then cap the radially exterior end 137*c*.

The external structure, especially the exoskeleton part, will be favourably made from soft steel, steels or more or less heat resistant alloys. Into it will therefore be fitted an insert (the above mentioned liner) made of a metal material as aforementioned and/or ceramic.

It will be understood that this allows:

that the insert guarantees obtaining the required geometry for the cast part and the control of solidification via the control of thermal constraints, and that the external structure guarantees the positioning of the mould on the centrifuge casting assembly as well as the unit's mechanical strength.

Figure 17:
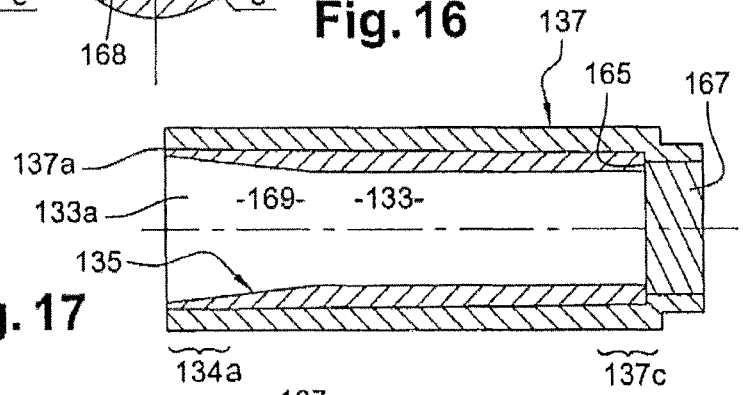
Figure 18:
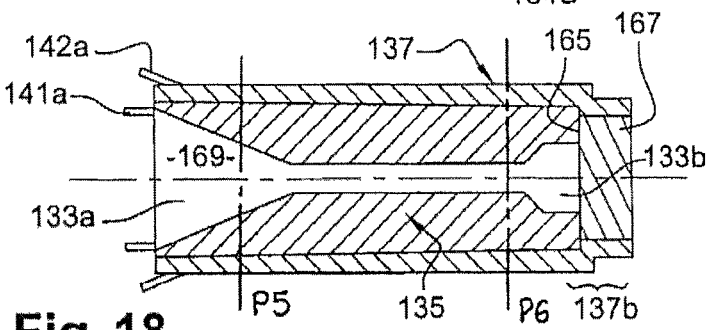
Figure 19:
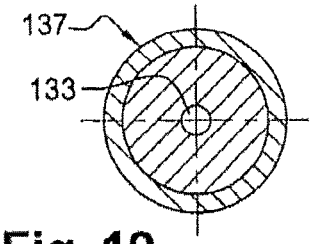
Figure 20:
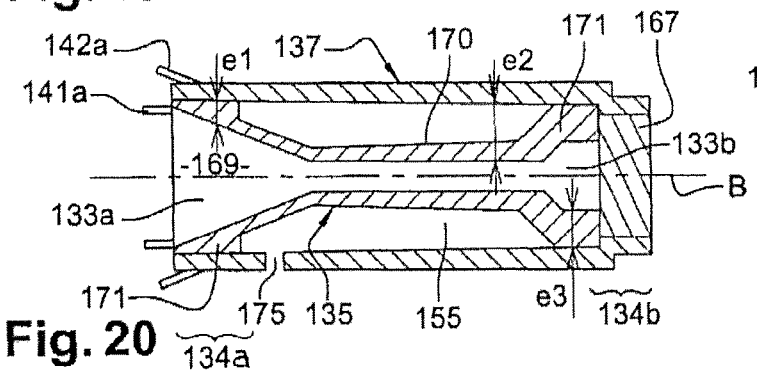

To persevere in heat control, preferably combined with that of the forces, it is recommended that, transversally to the radial direction along which they extend (B axis of the liner in question), the liners should each have a thickness that varies along the said radial direction (length L) and which is, at least globally, lesser towards at least one of the radially interior and exterior ends, 134*a*, 134*b*, than in the intermediate part, as shown in FIGS. 17, 18, 20; see also thicknesses e1, e2 and e3 FIG. 20. In other terms, can be found, along an axis B, a shape 133 that has a narrowing cross section from the end 133*a*, towards an intermediate zone, and then eventually (FIGS. 18, 20) widens towards the other end 133*b*.

If necessary in connection with this aspect, FIGS. 17, 18, 20 show the interest of having a mould where, individually, the radially interior opened end 133*a* and the central alloy pouring duct 133 of all or part of the liners 135 is of a shape 169 therefore narrowing in its cross section towards the centre of the liner, along the radial direction B, along which the corresponding liner extends. It is to be noted that shape 169 can ether have a single or a double funnel (head to foot). The trunk of a cone could be suitable.

As for the radially exterior end part of this duct, near the end 134*b* (FIGS. 18, 20), it could be flanged, to have a widened terminal part 133*b*.

FIG. 20 shows that longitudinal reinforcements 171 can be provided to guarantee the rigidity, centring and/or guiding of the liner 135 in question in the peripheral structure 137. The reinforcements are radially prominent compared to the rest of the liner in question.

A positioning of the reinforcements 171 towards the radial ends 134*a*, 134*b* will make it possible to clear the intermediate zones along the length of the mould, such that at least a space 155 favourable to the control of the constraints and the thermal inertia, the objective being to always reach a low thermal inertia to allow the even cooling of the cast metal shape.

Figure 21:
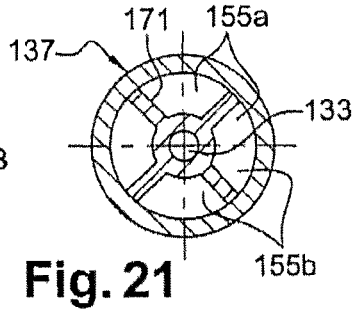
Figure 22:
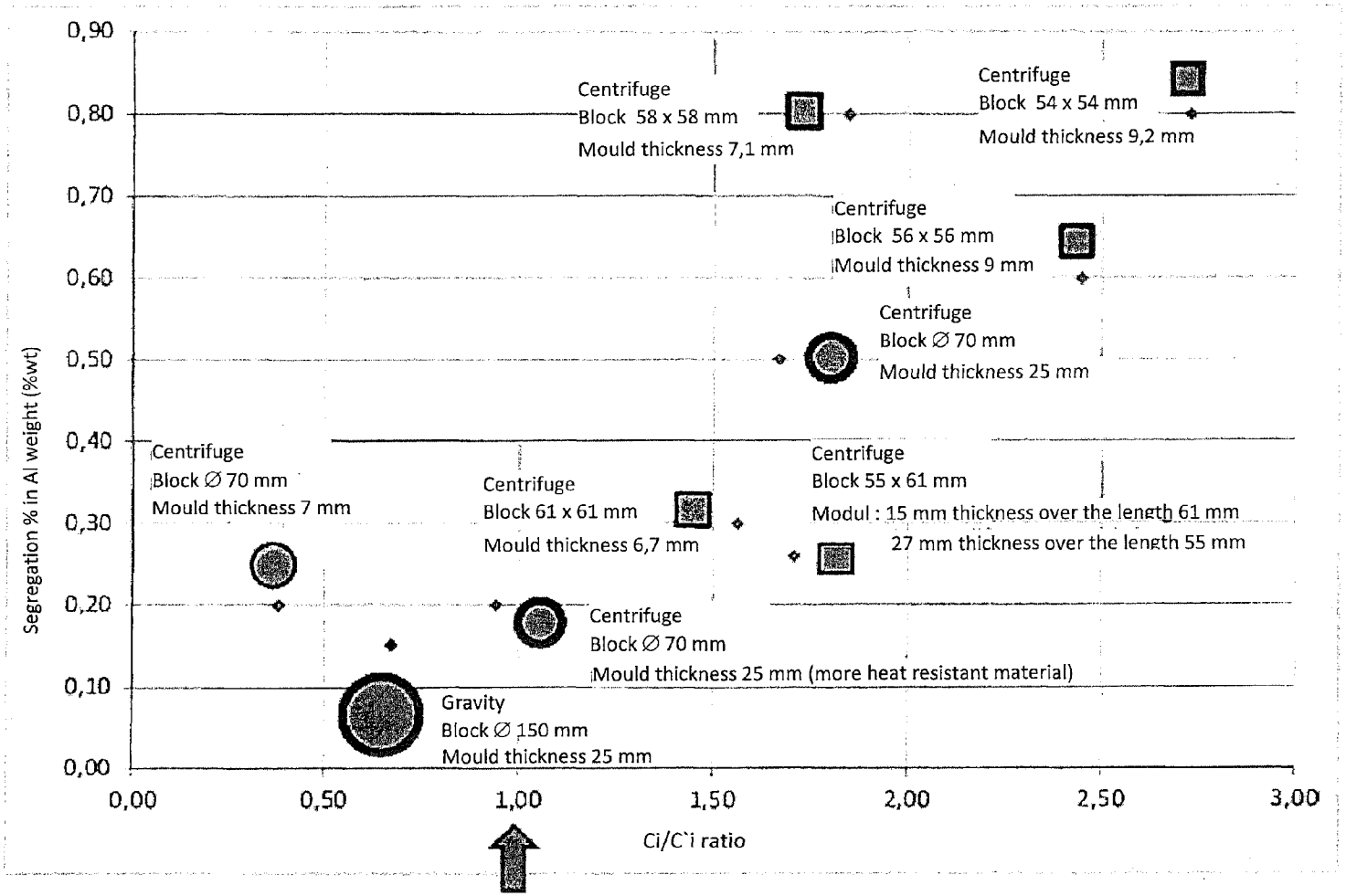

FIG. 21, the reinforcements 171 are radial to the axis of the schematic liner and between them define several free spaces, or secondary cavities, such as 155*a*, 155*b*.

For a use of the mould in a vacuum, the free space(s) and secondary cavities 155*a*, 155*b* created between the peripheral structure 137 and the external face of the liner in question 135, comprising the external surfaces of the machined (half) shells, a "venting" of the exterior of space 155 is recommended.

For this purpose, it is proposed that this space 155 have a fluid connection to the external environment of the mould via at least one hole 175. In a specific example of manufacture, each bar 110 may have a length or axial dimension of between 10 and 50 cm, an external cross section (such as a diameter) between 5 and 20 cm, an internal cross section (such as a diameter) between 4 and 10 cm and a radial thickness of between 1 and 10 cm, on average at the location of a given cross section.

The invention claimed is:

1. Unit comprising:

a mould rotating around an axis, for centrifuge casting, and a TiAl metal alloy poured thereinto, the mould including:

receiving recesses made of soft steel, steel, metal alloy and/or ceramic, adapted to receive the centrifuge casting of the said molten TiAl metal alloy, the recesses extending radially around the axis, and liners defining all the recesses and which are housed in at least one hollow soft steel, steel or metal alloy exoskeleton, and at the location of a plurality of section planes each passing through the mould and the poured metal alloy, the mould having a surface heat capacity less than that of the poured metal alloy, of which:

the exoskeleton or exoskeletons is/are open-worked, or an empty space exists around the periphery between each liner and the exoskeleton that surrounds it, or an alveolar structure exists around the periphery between each liner and the exoskeleton that surrounds it.

2. A centrifuge casting mould, specific for the unit of claim 1, the mould being rotational around an axis and comprising:

several receiving recesses to receive a molten TiAl alloy extending radially around the axis, and liners defining all the recesses and which are housed in at least one hollow exoskeleton, the exoskeleton or exoskeletons being made of soft steel, steel or metal alloy, and the liner being made of soft steel, steel or metal alloy and/or ceramic, and the exoskeleton or exoskeletons is/are open worked, or an empty space exists around the periphery between each liner and the exoskeleton that surrounds it, or an alveolar structure exists around the periphery between each liner and the exoskeleton that surrounds it.

3. The mould of claim 2, comprising a central block having ducts through which the alloy is poured and which are connected to the interior liners, and at least one fixing, preferably removable, is implemented:

between each liner and the exoskeleton that surrounds it, and/or between each liner and/or the exoskeleton that surrounds it and the central block.

4. The mould of claim 2, wherein the liners being filled with molten metal alloy, the said mould has a surface heat capacity less than that of the contained metal alloy, this occurring at a plurality of section planes passing respectively through at least one of the said liners and the exoskeleton that surrounds it and the contained metal alloy.

* * * * *